US006543703B2

(12) United States Patent
Blake

(10) Patent No.: US 6,543,703 B2
(45) Date of Patent: Apr. 8, 2003

(54) FLEXIBLE FACE NON-CLOGGING ACTUATOR ASSEMBLY

(76) Inventor: William S. Blake, 14 Georgetown Ct., Linwood, NJ (US) 08221

( * ) Notice: Subject to any disclaimer, the term of this patent is extended or adjusted under 35 U.S.C. 154(b) by 0 days.

(21) Appl. No.: 09/748,730

(22) Filed: Dec. 26, 2000

(65) Prior Publication Data

US 2002/0088873 A1 Jul. 11, 2002

(51) Int. Cl.[7] ..... B05B 15/02; B05B 1/34

(52) U.S. Cl. ..... 239/106; 239/337; 239/533.13; 239/533.15; 239/452; 239/464; 239/571

(58) Field of Search ..... 239/337, 533.13, 239/533.15, 452, 464, 546, 571, 106

(56) References Cited

U.S. PATENT DOCUMENTS

| | | | | |
|---|---|---|---|---|
| 3,104,785 A | | 9/1963 | Beard, Jr. | 222/207 |
| 3,437,270 A | * | 4/1969 | Venus, Jr. | |
| 3,545,682 A | * | 12/1970 | Beard | |
| 3,790,034 A | | 2/1974 | Horvath | 222/153 |
| 3,792,800 A | | 2/1974 | Capra et al. | 222/43 |
| 3,940,029 A | | 2/1976 | Horvath | 222/340 |
| 4,057,176 A | | 11/1977 | Horvath | 222/193 |
| 4,174,052 A | | 11/1979 | Capra et al. | 222/207 |
| 4,222,500 A | | 9/1980 | Capra et al. | 222/207 |
| 4,241,853 A | | 12/1980 | Pauls et al. | 222/207 |
| 4,260,082 A | | 4/1981 | Rooney et al. | 222/340 |
| 4,313,569 A | * | 2/1982 | Burke | 222/380 |
| 4,485,943 A | | 12/1984 | Czech | 222/256 |
| 4,512,514 A | | 4/1985 | Elcott | 239/99 |
| 4,564,130 A | | 1/1986 | Eulenburg | 222/207 |
| 4,607,762 A | | 8/1986 | Zulauf et al. | 222/48 |
| 4,858,788 A | | 8/1989 | Meckenstock | 222/207 |
| 4,872,595 A | | 10/1989 | Hammett et al. | 222/209 |
| 4,892,232 A | | 1/1990 | Martin | 222/207 |
| 5,181,658 A | | 1/1993 | Behar | 239/493 |
| 5,183,185 A | | 2/1993 | Hutcheson et al. | 222/209 |
| 5,370,317 A | * | 12/1994 | Weston | 222/494 |
| 5,477,258 A | | 12/1995 | Suzuki | 222/494 |
| 5,480,095 A | | 1/1996 | Stevenson et al. | 239/104 |
| 5,560,544 A | | 10/1996 | Merritt et al. | 239/104 |
| 5,642,860 A | | 7/1997 | Bush et al. | 239/333 |
| 5,657,930 A | * | 8/1997 | Battegazzore | 239/333 |
| 5,664,706 A | | 9/1997 | Cater | 222/321.2 |
| 5,676,311 A | | 10/1997 | Hartman | 239/120 |
| 5,687,877 A | | 11/1997 | Smolen, Jr. | 222/1 |
| 5,769,325 A | * | 6/1998 | Jouillat et al. | 222/333 |
| 5,829,435 A | | 11/1998 | Rubsamen et al. | 128/203.21 |
| 5,855,322 A | * | 1/1999 | Py | 239/11 |
| 5,857,595 A | | 1/1999 | Nilson | 222/212 |
| 5,894,964 A | | 4/1999 | Barnes et al. | 222/402.1 |
| 5,918,774 A | | 7/1999 | Lund et al. | 222/153.13 |
| 5,967,369 A | | 10/1999 | Käfer et al. | 222/82 |
| 6,053,433 A | * | 4/2000 | Py | 239/333 |
| 6,063,055 A | | 5/2000 | Epstein et al. | 604/82 |

FOREIGN PATENT DOCUMENTS

| | | | |
|---|---|---|---|
| EP | 0 370 257 | 5/1990 | F16K/15/14 |
| FR | 2 767 311 | 2/1999 | B65D/47/20 |
| FR | 2 792 552 | 2/2000 | B05B/1/28 |
| WO | WO 02/51553 A1 | 12/2001 | B05B/1/34 |

* cited by examiner

*Primary Examiner*—Robin O. Evans

(57) ABSTRACT

A non-clog actuator assembly having a flexible face member that flexes away from first and second positive shutoff mating surfaces when product under pressure flows into contact with the flexible face member. The flexible face member then resiliently springs back into abutting, sealing contact with these shutoff mating surfaces. Preferably, the device flexes away from the two shutoff mating surfaces at a predetermined minimum pressure, such as 55 psig, and then flexes back into sealing contact when the product pressure drops below this minimum pressure, thereby controlling the dispensing of the product with a positive shut off (i.e., the product is dispensed in a fairly constant pattern and then shut off rather than being very strong at the beginning of the spraying process and then dribbling out at the end or under low pressure operations).

49 Claims, 13 Drawing Sheets

FLEXIBLE FACE NON-CLOGGING ACTUATOR ASSEMBLY

BACKGROUND OF THE INVENTION

1. Field of the Invention

The present invention relates to actuator assemblies that are suitable for use on aerosol dispensers or pumping assemblies. More particularly, it relates to an actuator assembly which is effective in preventing or reducing the clogging which is caused by the drying and hardening of the product being dispensed within the flow channels and discharge orifice of the actuator assembly.

2. Description of the Related Art

Actuator assemblies that fit on the top of aerosol containers or that are used as part of a pumping system have been used for many years to dispense liquid or product under pressure out of a small opening. Often, the liquid or product is atomized as it exits the actuator assembly to disperse the liquid in a fine spray using a specially configured nozzle or other mechanism. While these devices typically work well initially, they typically become partially or fully clogged as the product being dispensed dries and hardens in various flow channels and in the discharge orifice. Many of these other actuators rely on mechanical force, such as a spring or other mechanism, to open an orifice and flow channels for dispensing by withdrawing a probe or plug from the orifice and then closing the orifice after dispensing the product by moving the probe or plug back towards or into the orifice.

By way of example, U.S. Pat. No. 5,198,774 of Lund et al, discloses a combined lock and anti-clog actuator. The actuator is adjustable between a locked and an unlocked position. The locked position cooperates with an anti-clog member, which has a nozzle seal for inhibiting the clogging of the product within.

U.S. Pat. No. 5,894,964 of Barnes et al, discloses an inner actuator chamber arranged in a way designed to minimize blockage of the actuator.

U.S. Pat. No. 5,480,095 of Stevenson et al, shows an actuator that attenuates the accumulation of solidified sprayed fluid.

U.S. Pat. No. 5,687,877 of Smolen, Jr., discloses a pump dispenser with a check valve that moves forward during the pressure stroke and that closes and pulls liquid back during the suction stroke, minimizing blockage.

U.S. Pat. No. 5,560,544 of Merritt et al. discloses an anti-clogging atomizer nozzle.

U.S. Pat. No. 4,982,900 of Blake discloses a trigger sprayer with several nose piece valve constructions.

Despite the efforts of such devices as shown in the foregoing patents, there remains a need for an anti-clogging actuator that can perform a rapid positive shut off. Specifically, a product that can prevent clogging from occurring by effecting a rapid shut off; that would afford an effective shut off method to prevent product build up behind the orifice on seating surfaces and in flow channels; and that would create a positive shut off to reduce dribbling or seeping under low pressure would be desirable.

SUMMARY OF THE INVENTION

It is an object of the present invention to provide a non-clogging actuator assembly outlet valve which traps and isolates fluid within the inlet/outlet channels of the actuator to prevent air migration.

It is a related object of the present invention to provide a non-clogging actuator assembly that has double one-way valving with flexible movement to afford mechanical breakup of hardened product.

It is another object of the present invention to provide a non-clogging actuator assembly that has a positive shut-off to reduce dribble or seeping.

It is a related object of the present invention to provide a non-clogging actuator assembly that is commercially advantageous by having a relatively small number of parts, easily molded without complex actions, and adaptable for use in existing and future aerosol containers; and which lends itself to a variety of assembly modes and an assembly sequence that allows for subassembly pretesting before final assembly.

Additional objects, advantages, and novel features of the invention will be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described herein, an actuator assembly is provided that addresses the above discussed clogging problem. The actuator assembly according to this invention includes a flexible face member that flexes away from first and second positive shutoff mating surfaces when product under pressure flows into contact with the flexible face member. The flexible face member then resiliently springs back into abutting, sealing contact with these shutoff mating surfaces. Preferably, the device flexes away from the two shutoff mating surfaces Express at a predetermined minimum pressure, which in the preferred embodiment is 55 psig, and then flexes back into sealing contact when the product pressure drops below this minimum pressure, thereby controlling the dispensing of the product (i.e., the product is dispensed in a fairly constant pattern and then shut off rather than being very strong at the beginning of the spraying process and then dribbling out at the end or under low pressure operations). Those skilled in the art will recognize that any minimum predetermined pressure required to activate the disclosed assembly will vary with the type material and the geometry selected for the individual components.

Other features and advantages of the invention will become clear from the following detailed description and drawings of particular embodiments of the actuator system and method and associated combinations and features of the present invention.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE INVENTION

With the above summary in mind, it may now be helpful in fully understanding the inventive features of the present invention to provide in the following description a thorough and detailed discussion of a number of specific embodiments of the invention.

Figure 1:
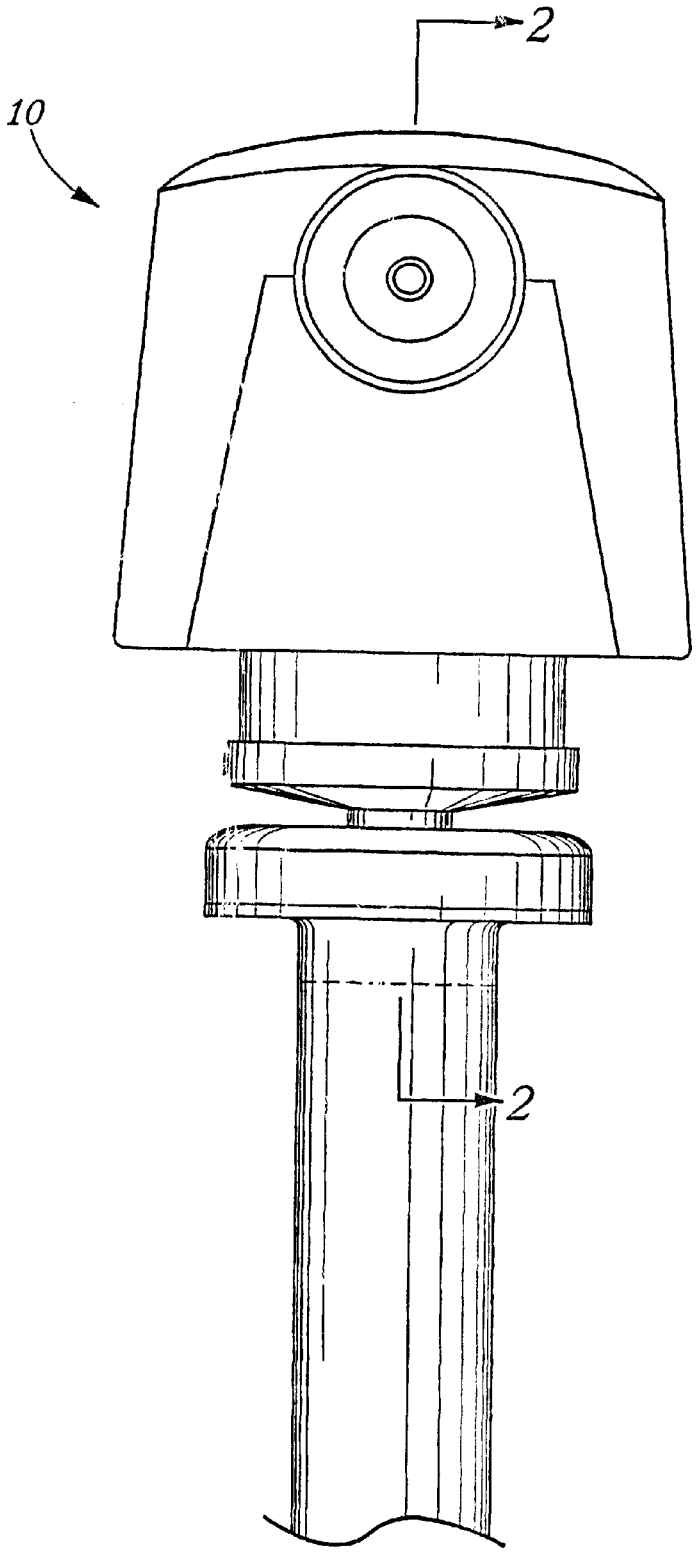
FIG. 1 is a front view of the preferred embodiment of the actuator assembly of this invention.
Figure 2:
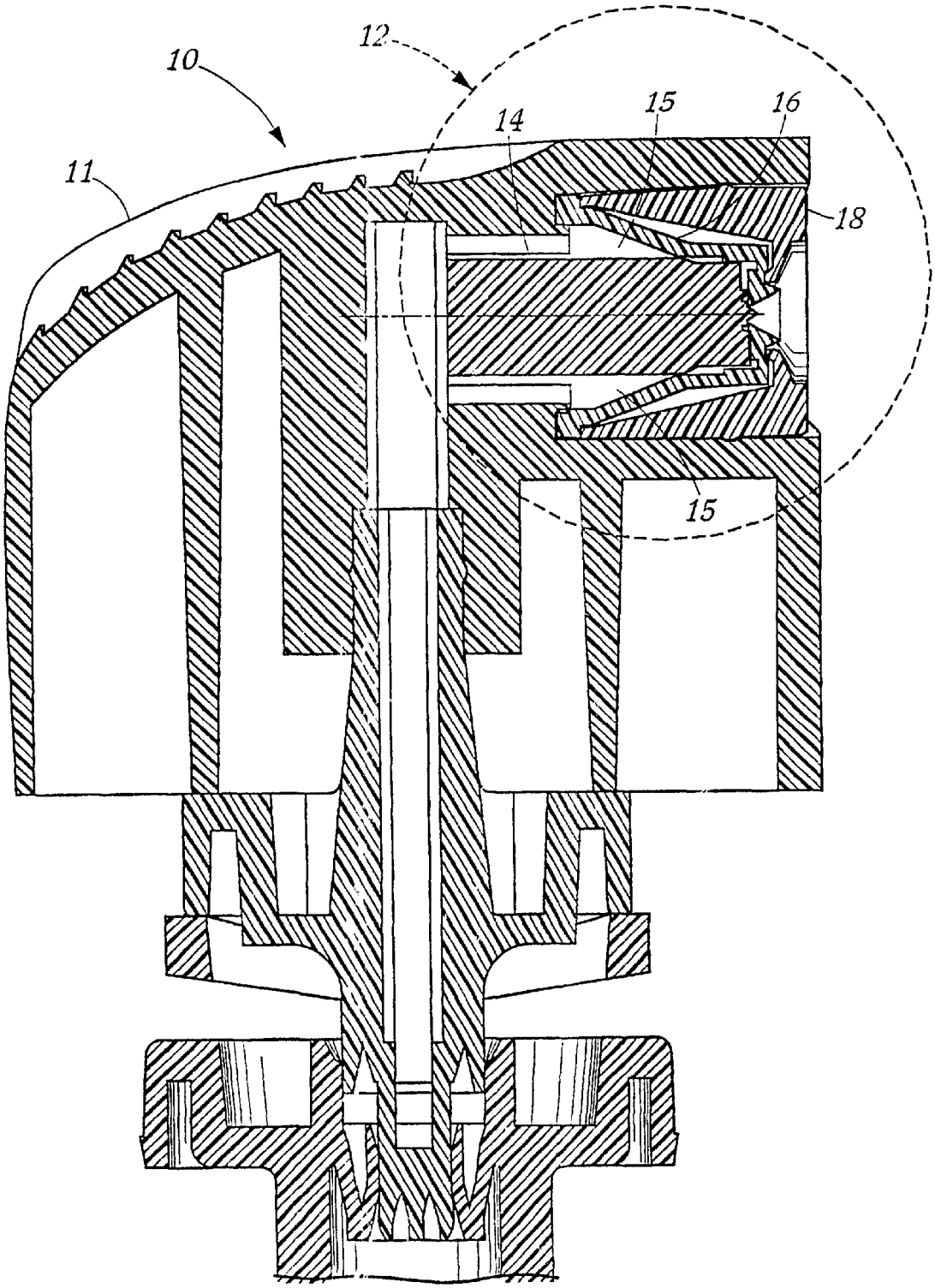
FIG. 2 is a sectional side view of the actuator assembly of FIG. 1.
Figure 3:
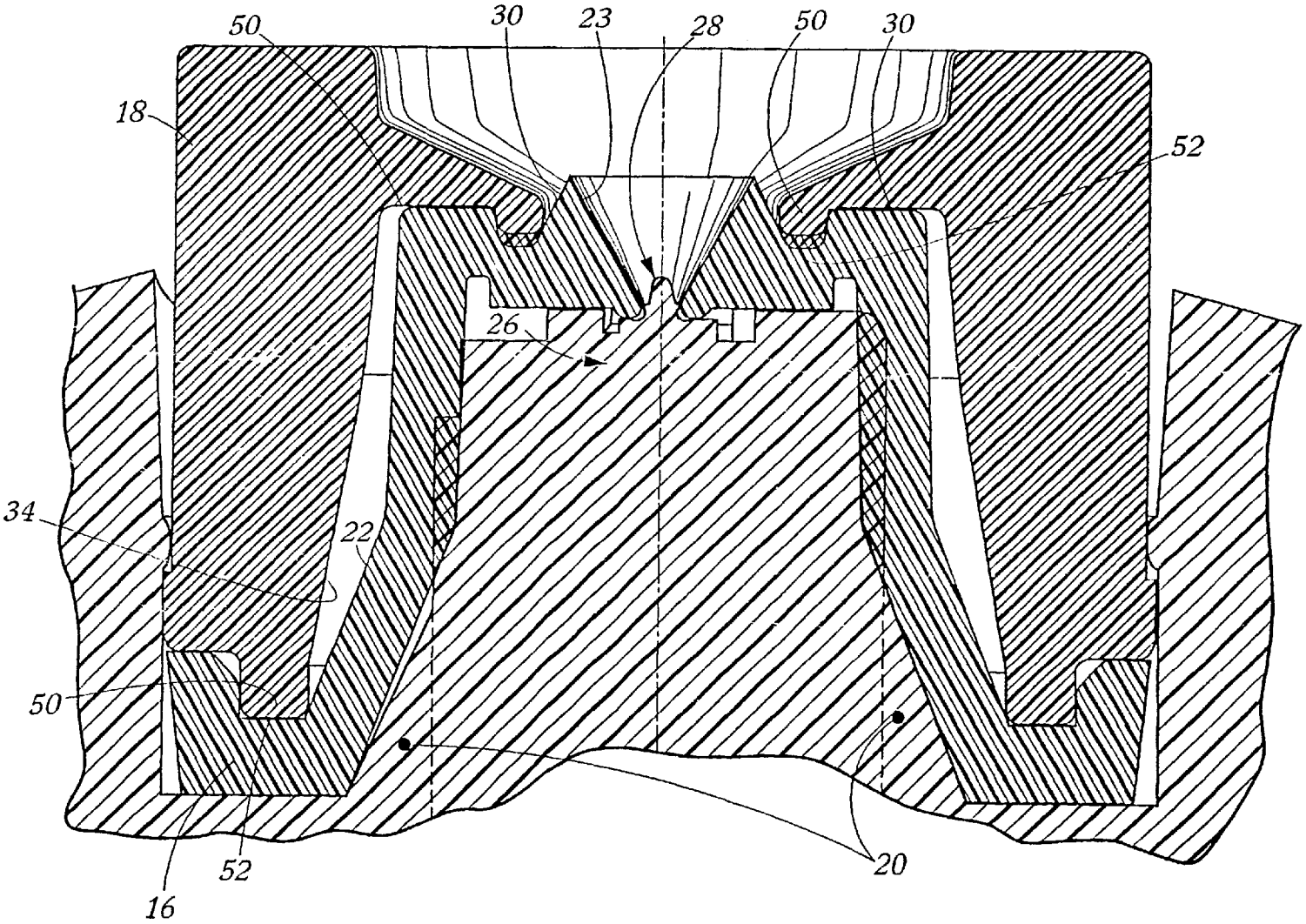
FIG. 3 is a detailed sectional view of the assembly of FIG. 1 particularly illustrating the registration/alignment of the actuator assembly's sub-components.

Most generally, and referring to FIGS. 1–6, it may be seen in overview that the actuator assembly 10 according to this invention provides a flexible face member (or fitment) 16 that flexes away from first and second positive shutoff mating surfaces (a First mating surface at side 24 of stem 14 and a second mating surface at face 26 of stem 14, as shown for example in FIG. 3) when product under pressure flows into contact with the flexible face member 16. From viewing the figures, it may be understood that the flexible face member 16 then resiliently springs back into abutting, sealing contact with these shutoff mating surfaces 24 and 26 when the pressure is decreased. Preferably, the flexible face member 16 flexes away from the two shutoff mating surfaces at a predetermined minimum pressure and then flexes back into sealing contact when the product pressure drops below this minimum pressure, thereby controlling the dispensing of the product (i.e., the product is dispensed in a fairly constant pattern and then shut off rather than being very strong at the beginning of the spraying process and then dribbling out at the end or under low pressure operations).

FIG. 1 illustrates a front view of the actuator assembly 10 and FIG. 2 illustrates a sectional view of the actuator assembly 10. The actuator portion 12 is shown in a dashed circle, and this is the portion of the actuator assembly 10 that provides flow control features (i.e., anti-clogging features and anti-dribbling features).

As shown in FIG. 2, the actuator 12 comprises a stem 14 about which product can flow in a feed channel 15. The actuator 12 is seated into the cap 11 of the actuator assembly 10 and is illustrated in FIG. 2 in the closed position so that the product cannot exit the actuator 12. The actuator 12 further includes a flexible face fitment 16 fabricated from a flexible material, such as plastic or rubber, that provides the resiliency for flexing away from the stem 14 when the product in feed channel 15 reaches a predetermined minimum pressure and then returning to its original shape when the pressure is reduced below that minimum pressure. The flexible face fitment 16 is held in place with compression fitting 18 which also defines the location and amount of flexing or change in shape that the flexible face fitment 16 undergoes when under pressures above the minimum pressure.

Figure 4:
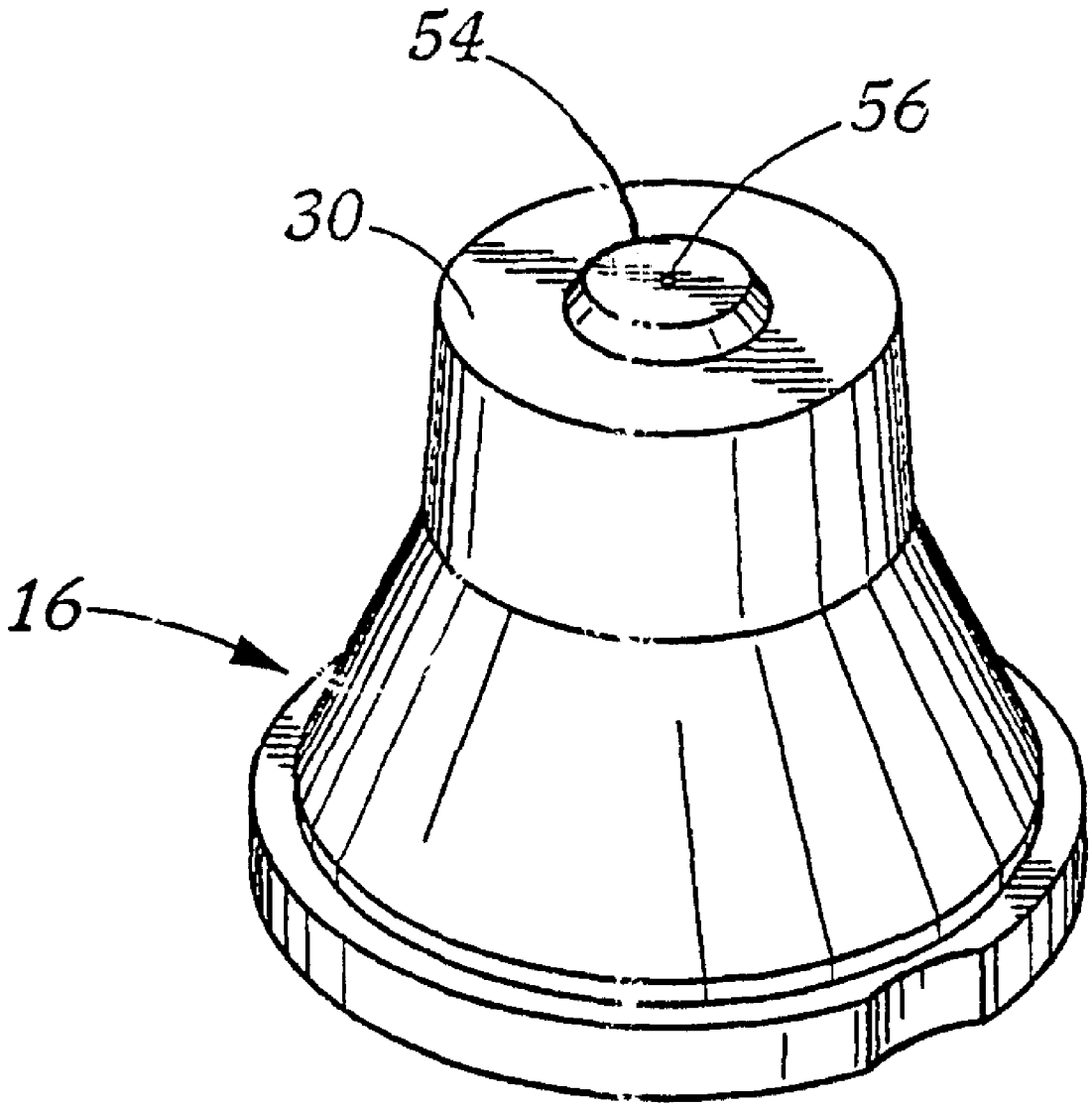
FIG. 4 is a perspective view of the flexible face fitment of the actuator assembly of FIG. 1.
Figure 5:
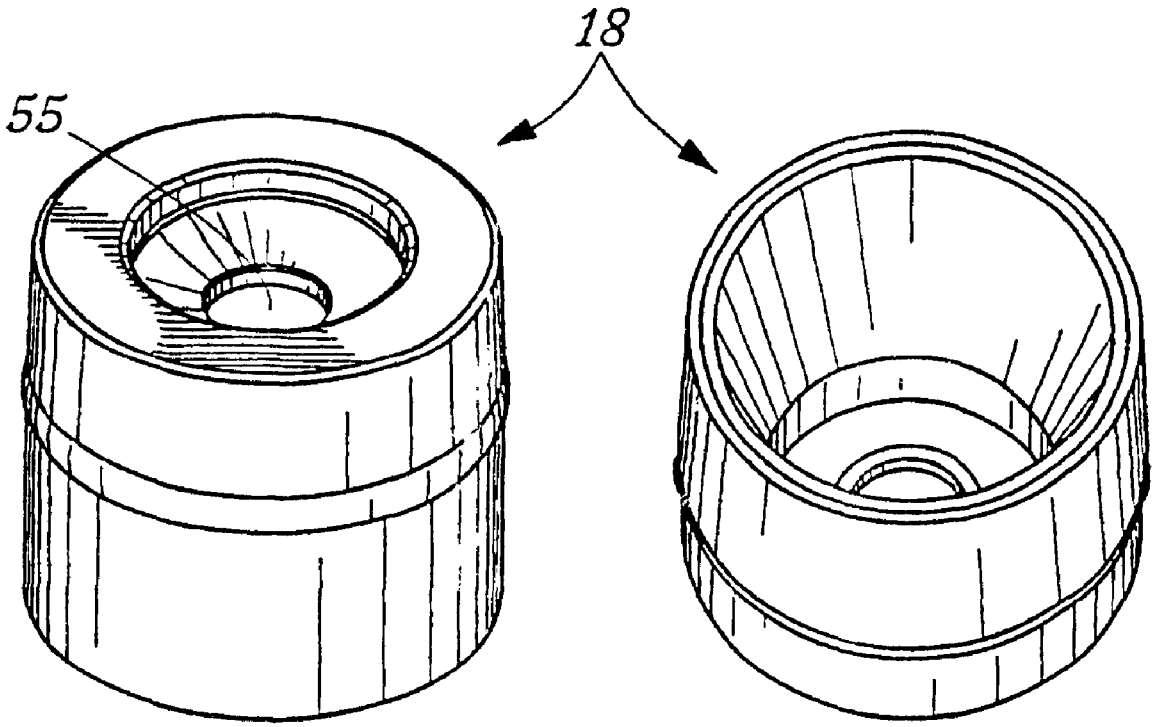
FIG. 5 is a pair of perspective views of the compression fitting of the actuator assembly of FIG. 1.
Figure 6:
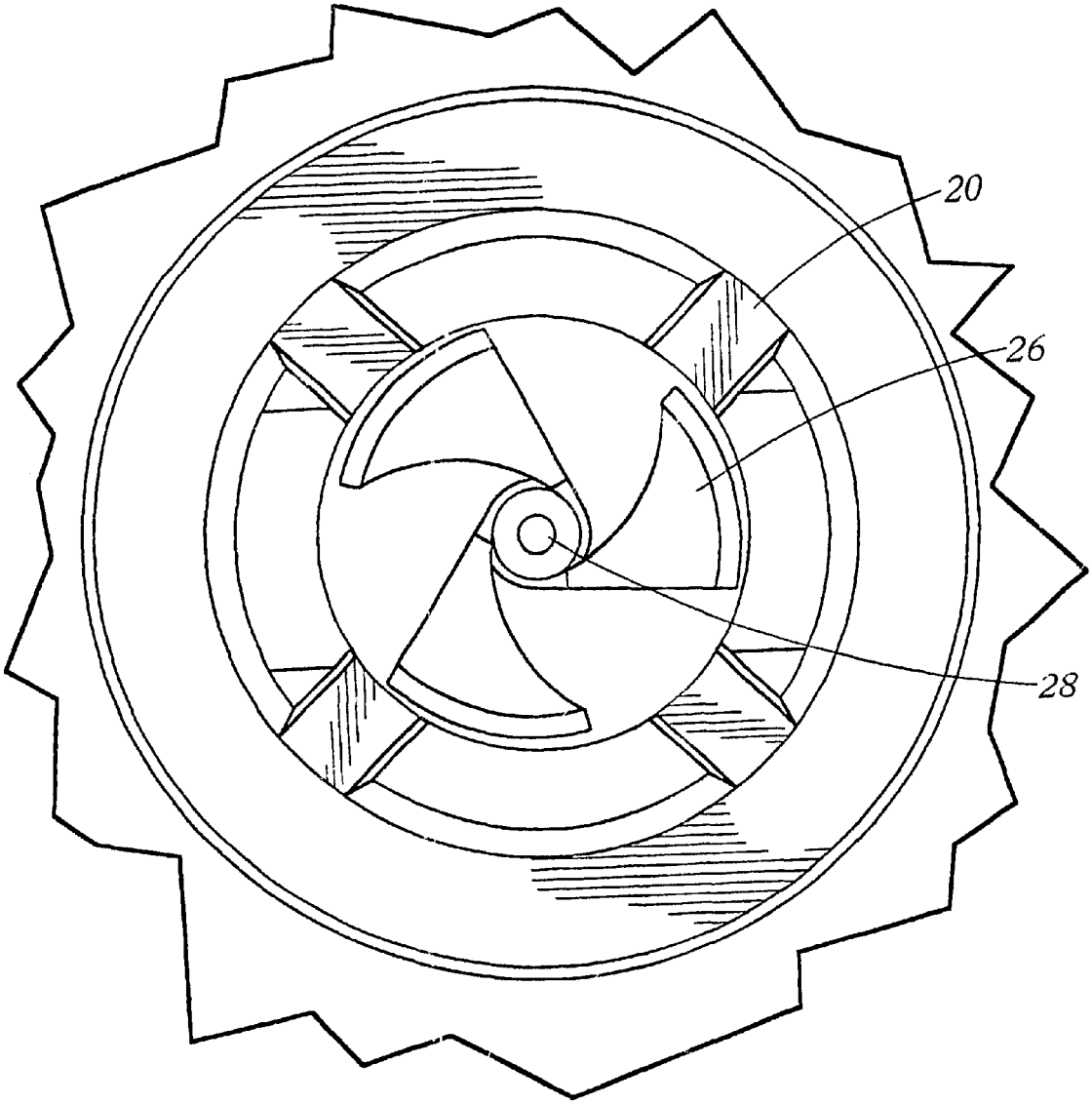
FIG. 6 is an overhead view of the actuator turbo of the actuator assembly of FIG. 1.

With reference now to FIGS. 3–6, certain aspects of the actuator 12 will be more fully described. Turning to FIGS. 3 and 6, the stem 14 is shown sectionally to illustrate the vanes 20 that provide stem stabilization and define flow paths for the product to contact the side wall 22 of the flexible face fitment 16 and to flow to the orifice 23 of the flexible face fitment 16. The stem 14 also includes an upper, side mating surface 24 and an actuator turbo face 26 with a turbo tip or nipple 28.

The actuator turbo tip 28 is shown in detail in FIG. 6 and in combination with the flow channels created by the configuration of the upper portion of the stem 14 creates vortex flowing, action that effectively atomizes the product as it flows through these channels and over the actuator turbo face 26. The actuator turbo face 26 includes a tip or nipple 28 at the center of the face 26 that is configured to mate with the bottom surfaces of the orifice 23 (see FIG. 3) of the flexible face fitment 16 to provide better sealing. The flexible face fitment 16 further includes a flexible sealing face 30 to provide a sealing surface to mate with the actuator turbo face 26.

FIG. 4 provide an enlarged view of the flexible face fitment 16 and FIG. 5 provides enlarged views of the compression fitting 18 that is used to hold the flexible face fitment 16 within the actuator assembly 10.

To further understand the features of the invention, it may be useful to provide a quick overview of the movement of the components during operation of the actuator assembly 10.

When the actuator assembly 10 is closed or shut, the flexible face fitment 16 is in a biased state in an "at rest" position (see FIGS. 1–3) in which the side wall 22 of fitment 16 abuttingly and sealably contacts the side mating surface 24 of the stem 14 (see FIG. 3); and the flexible sealing face 30 of fitment 16 contacts the top mating surface of the actuator turbo face 26 of the stem 14, with such contact being made, at a minimum, at the base of the tip 28 on face 26 of stem 14. In this fashion, two sealing surfaces are provided. The sealing surface between the face 26 and tip 28 of the stem 14, and the face 30 of fitment 16, controls the escape of moisture thereby reducing the amount of drying and hardening of any product near the face 30 and the orifice 23. When the actuator cap 11 is pressed downward releasing pressurized product, the product flows into channel 15 (FIG. 2) and contacts the flexible face fitment 16. The flexible face fitment 16 is made of a material and has a wall thickness that resists movement/flexing until a predetermined minimum pressure is reached. In the disclosed embodiment, 55 psig is the preferred minimum pressure required, however, those skilled in the art will appreciate that a wide range of predetermined pressures could be effective depending upon what component materials and configurations are selected.

When the product in the channel 15 reaches this predetermined minimum pressure, the side walls 22 of the fitment 16 flex outward until they contact the inner side walls 34 of the compression fitting 18. This movement of the flexible face fitment 16 opens flow channels for the product along the stem 14 up to the face 30 of the flexible face fitment 16 and to the actuator turbo face 26 of the stem 14 (it being understood that the flexible face fitment 16 opens in an area of the fitment 16 that is within the opening of compression fitting 18—this area of the fitment 16 is referred to as the "expandable seal area" and is shown with reference numeral 54 in FIG. 4). The pressurized product forces a "face area" (reference numeral 56 in FIG. 4) that is within an opening (reference numeral 55 in FIG. 5) exposed by the compression fitting 18 and hereafter referred to as the "lip seal orifice" (reference numeral 56 in FIG. 4) to release the product in a spray pattern determined by various configurations of turbo-vortexing designs specified by certain product viscosities or formulations such as room fresheners or hair sprays (see, for example, 11A through 12B). These turbo-vortexing chambers are determined by existing formulae which are known to persons practicing in the field, and which are used to develop a certain pattern by way of parameters factored into them to yield a specific factor for optimum performance. The product is also atomized by the turbo face 26 and the flow channels, including vanes 20, of the stem 14 as it exits the actuator assembly 10. When the pressure of the product decreases below the minimum pressure (for example, when the cap 11 is released closing a valve(s) or for other reasons), the expandable seal area 54 of flexible face 30 of the flexible face fitment 16 closes against the tip 28 of the stem 14, and the side wall 22 of the flexible face fitment 16 returns to its mating position with the side wall 24 of the stem 14. This closing action is very rapid which minimizes any dripping or dribbling of product and is substantially simultaneous at each sealing surface.

In the preferred embodiment of the invention disclosed herewith, tabs 50 and grooves 52 (see FIG. 3) facilitate the alignment/registration of pieces during assembly and use, helping ensure that the pieces are set in the correct alignment and remain in concentric registration throughout use of the actuator assembly. Those skilled in the art will appreciate the numerous means by which to achieve a similar registration function, including the snap-fit methodology of FIG. 3 and the barb-fit methodology of FIG. 7. The geometry of the flexible face fitment 16 and compression fitting 18 provide for the operational concentricity and registration which, in turn, provides for optimum functional spray patterns. Such geometry is variable and may be seen in several alternate embodiments (see FIGS. 7 through 12B).

Of particular importance, the actuator assembly 10 according to this invention, may be utilized in a variety of applications. It may, for instance, replace existing mechanisms, and it may also be used on newly designed pumps or aerosolized mechanisms. Now that the invention has been explained, other actuator assembly embodiments may be readily understood.

Figure 7:
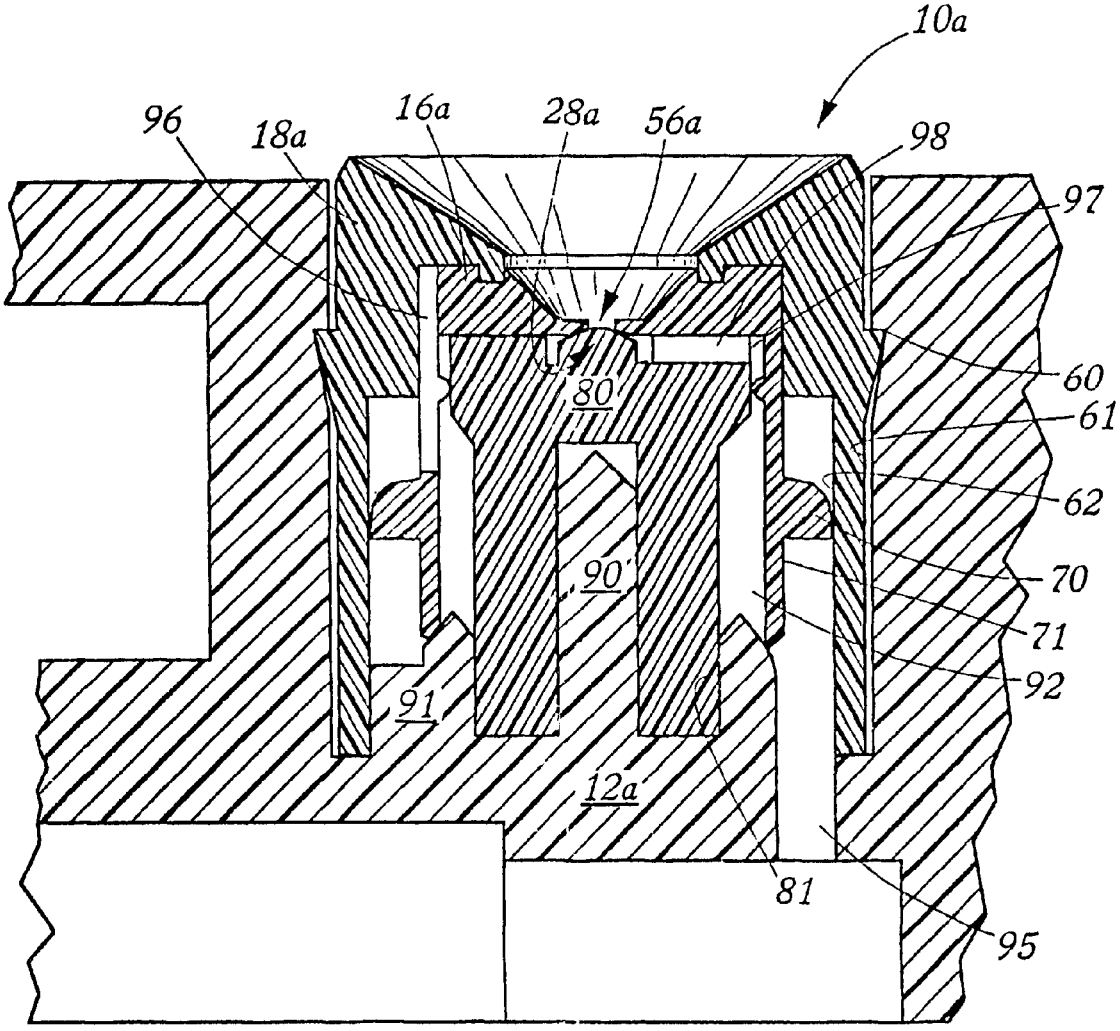
FIG. 7 is a sectional view of an alternate embodiment of the actuator assembly illustrated in FIGS. 1 through 6.

With reference to FIG. 7, the flexible face seal of this invention may be embodied in a four-piece design 10*a* that can be used as a retrofit to an existing actuator. The four pieces include: a compression fitting 18*a* similar in geometry and function to that disclosed in FIGS. 1–6, and further including a barb ridge 60 protruding from its otherwise cylindrical outer wall 61 that allows the secure seating and the alignment/registration of the four-piece design 10*a*; a flexible face fitment 16a that is also similar in function to that disclosed in FIGS. 1–6, and further including a washer-like seal bead ring 70 encircling the exterior of its side wall 71; a rigid stem fitment 80 disposed within the stem area of the previous embodiment, including a tip seal 28*a* and a side wall 81, with at least part of the tip seal 28*a* capable of abutting and sealably contacting the biased lip seal orifice 56*a* of the flexible face fitment 16*a*, and at least part of the side wall 81 capable of abutting and sealably contacting the side wall 71 of the flexible face fitment 16*a*; and an actuator fitment 12*a*, with one protrusion 90 essentially disposed beneath and within the rigid stem fitment 80, and a second protrusion in the form of an outer wall 91 surrounding the rigid stem fitment 80, its purpose to seal the area referred to as the capillary circumferential pocket 92, which is defined as the area between the flexible face fitment 16*a* and the rigid stem fitment 80, and to help ensure that the fitments are set in the correct alignment and remain in concentric registration throughout use of the actuator assembly.

The embodiment of FIG. 7 specifies a product flow path differing from that disclosed in the preferred embodiment illustrated in FIGS. 1–6. In this alternative embodiment, the product initially flows into a feed channel 95 when a predetermined minimum pressure is exerted upon the actuator 10*a*. The flowing product encounters a washer-like seal bead ring 70, disposed around the exterior of the side wall 71 of the flexible face fitment 16*a*. The product's contact with the seal bead ring 70 urges the side wall 71 of the flexible face fitment 16*a* inward, thus allowing product to enter three strategically positioned slots 96 which direct the product onto the 360-degree feed groove 97 at the peripheral edge leading into the vortexing channels 98. The product pressure within the vortexing channels 98 serves to lift the biased lip seal orifice 56*a* off the rigid stem fitment's tip seal 28*a* and the product is simultaneously atomized in a manner similar to that disclosed in the embodiment described in FIGS. 1–6. When the pressure drops below its critical value, the seal bead ring 70 and the side wall 71 of the flexible face fitment 16*a* flex outward, sealably contacting the flexible face fitment 16*a* to the rigid inner wall 62 of the compression fitting 18*a*, thus closing the path through which product flows. This outward flexing motion of the seal bead ring 70 and the side wall 71 also serves to increase the area within the capillary circumferential pocket 92 which effectively functions to reduce product bleeding at the end of the dispensing cycle by suctioning product from the three slots 96, the feed groove 97, and the vortexing channels 98.

The compression fitting 18*a*, serves the same purpose as in the embodiment already discussed, insofar as it encompasses all of the flexible face fitment 16*a*, with the exception of the lip seal orifice 56*a*, and it constrains the outward movement of the flexible face fitment 16*a* at the point when the flexible face fitment 16*a* contacts its rigid inner wall 62.

The rigid stem fitment 80 is concentrically registered with the flexible face fitment 16*a* and the compression fitting 18*a* through the placement of the actuator fitment 12*a* that is disposed within the rigid stem fitment 80 to secure its positioning and due to the protruding barb ridge 60 running around the outer wall 61 of the compression fitting 18*a*. In this embodiment, the vortexing channels 98 can either be located on the face of the rigid stem fitment 80 or on the underside of the flexible face fitment 16*a* and the actuator assembly will still yield similar results.

Figure 8:
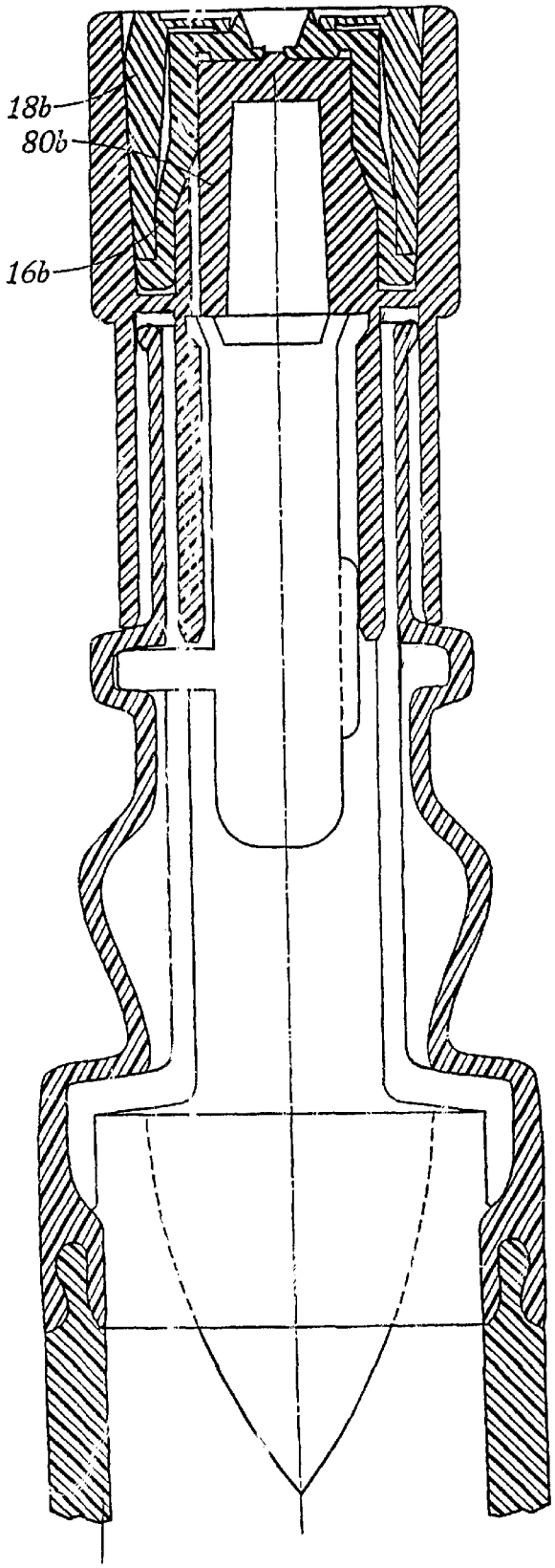
FIG. 8 is a sectional view of an alternate embodiment of the actuator assembly to be utilized as an outlet valving means in pumps having only inlet valving means.

With reference to FIG. 8, the flexible face seal of this invention may be embodied in a two-piece design that can be used as part of a custom designed actuator. This assembly shows that the actuator assembly disclosed in either FIGS. 1–6 or in FIG. 7 would be part of a pump assembly with or without an outlet valving means. This assembly would serve as the outlet means in those pumps having only inlet valving means. This presents an advantage over relevant art since the need for a separate outlet system is eliminated in newly designated pump concepts.

In this embodiment, a sub-assembly could be created combining a flexible face fitment 16*b*, a compression fitting 18*b*, and a rigid stem fitment 80*b* into a single component. This sub-assembly could be joined to another sub-assembly such that the actuator and pump body could be combined to form one piece which fits into a disposable reservoir to complete the system.

Figure 9:
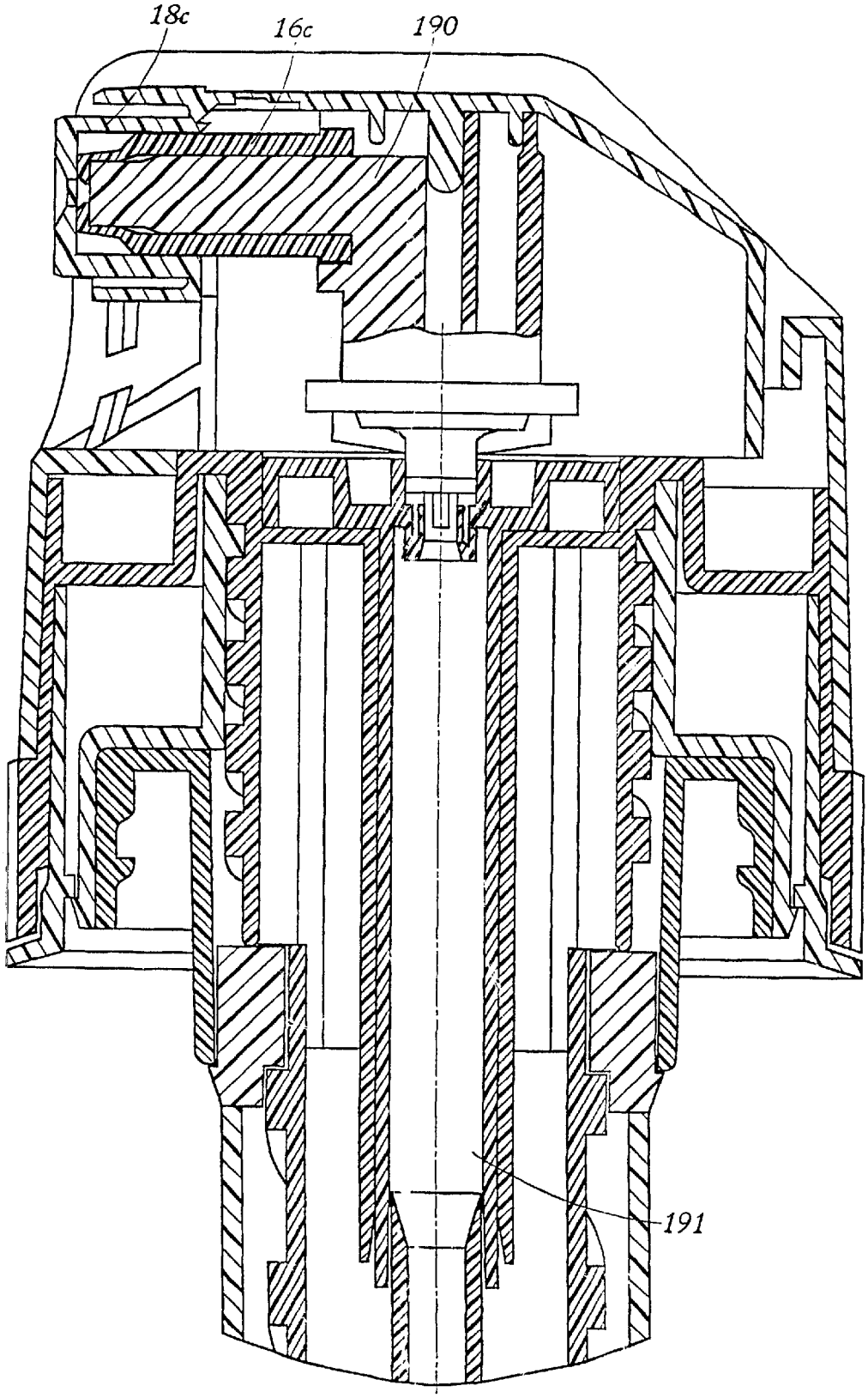
FIG. 9 is a sectional view of an alternate embodiment of the actuator assembly to be utilized with aerosol devices that require specific spray patterns.

With reference to FIG. 9, the flexible face seal of this invention may be embodied in another custom designed actuator, this actuator designed to fit onto a specially designed aerosol container requiring a unique spray pattern. In this embodiment, the flexible face fitment 16*c* is disposed over a valve post assembly 190 similarly to the embodiments disclosed in FIG. 7. As in the other disclosed embodiments, the compression fitting 18*c* is disposed over the flexible face fitment 16*c* to arrest its outward motion when the actuator assembly is under a predetermined required pressure. The distinction of this embodiment is dictated by the geometry of the container's housing. The structural nature of the aerosol container requires an elongated stem area 191 in order to place the orifice on the edge of the aerosol can. This embodiment utilizes the basic product flow and dispensing means disclosed above.

Figure 10A:
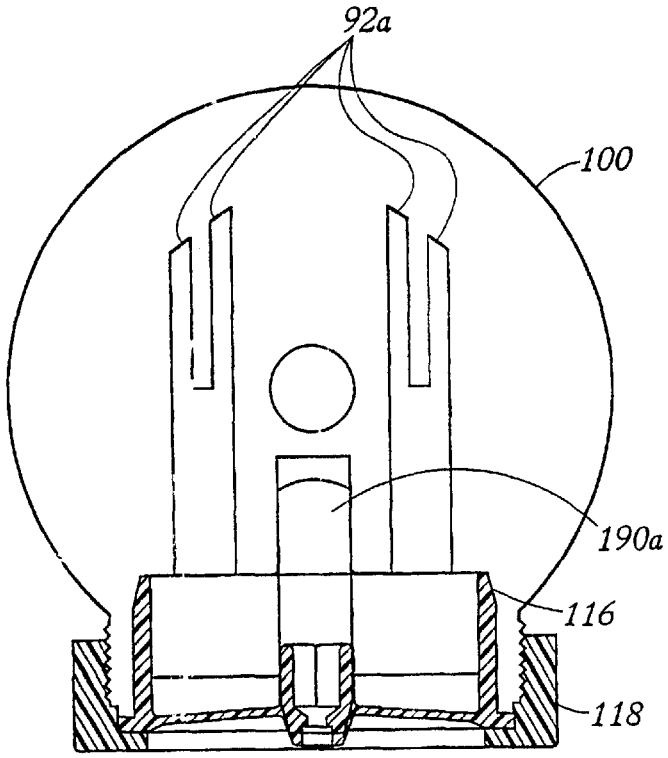
FIG. 10A is an overhead view of an alternate embodiment of the actuator assembly of FIG. 1 particularly illustrating capillary pockets that reduce bleeding at the completion of a spray cycle.
Figure 10B:
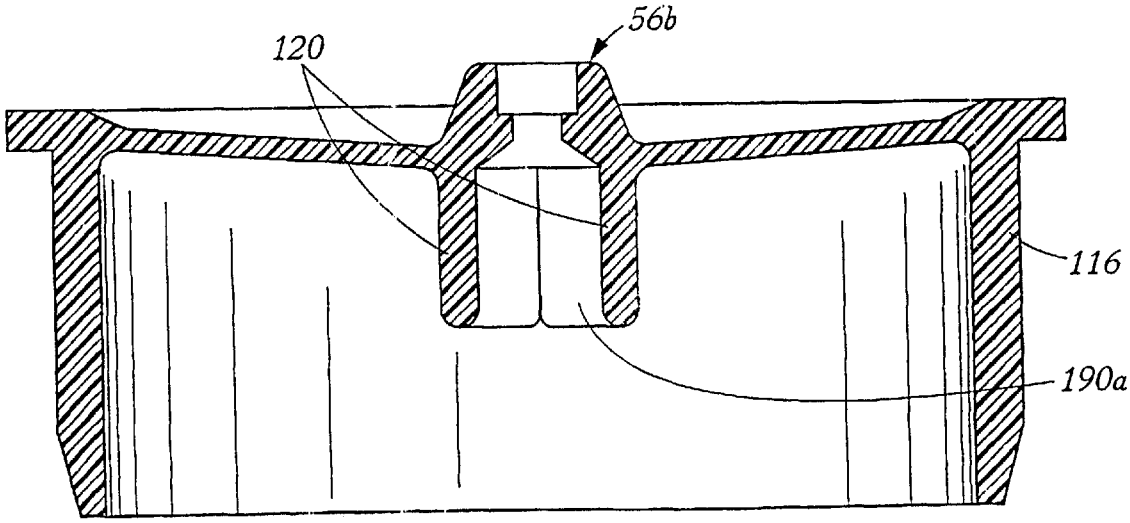
FIG. 10B is a sectional view of an alternate embodiment of the flexible face fitment of FIG. 4 particularly illustrating the two depending walls that sealably contact the valve post.
Figure 10C:
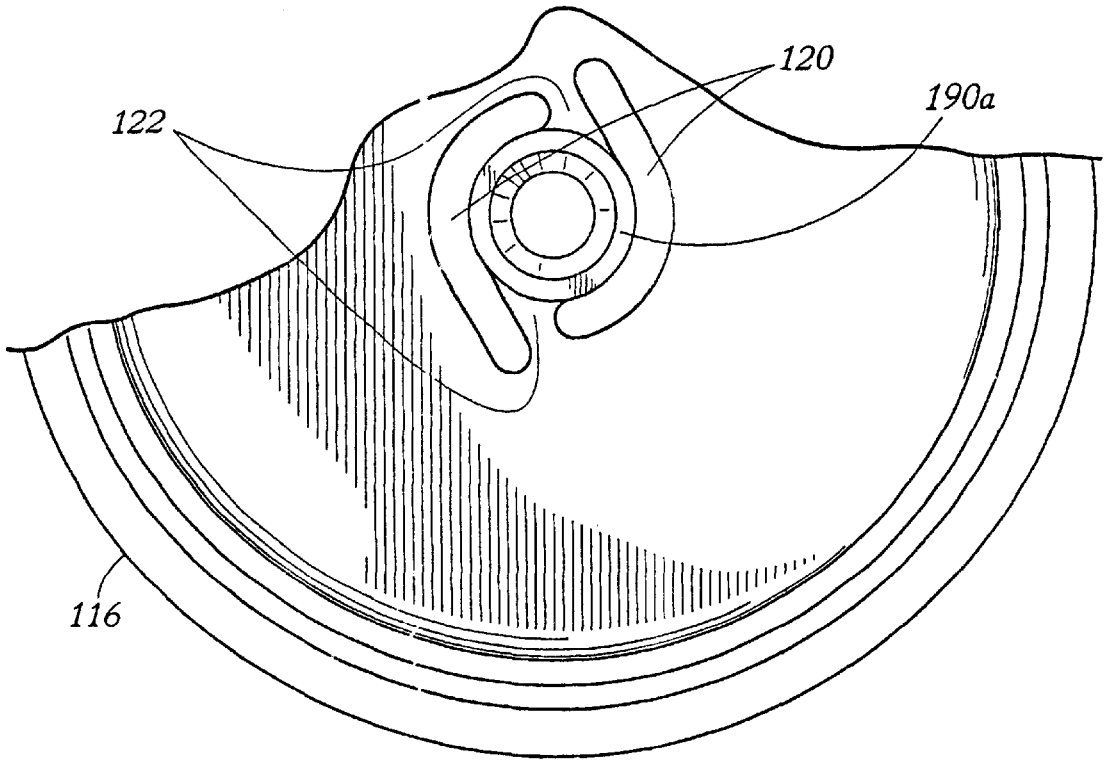
FIG. 10C is a bottom view of the two depending walls of FIG. 10B particularly illustrating the wall's openings that allow for product entrance.
Figure 11A:
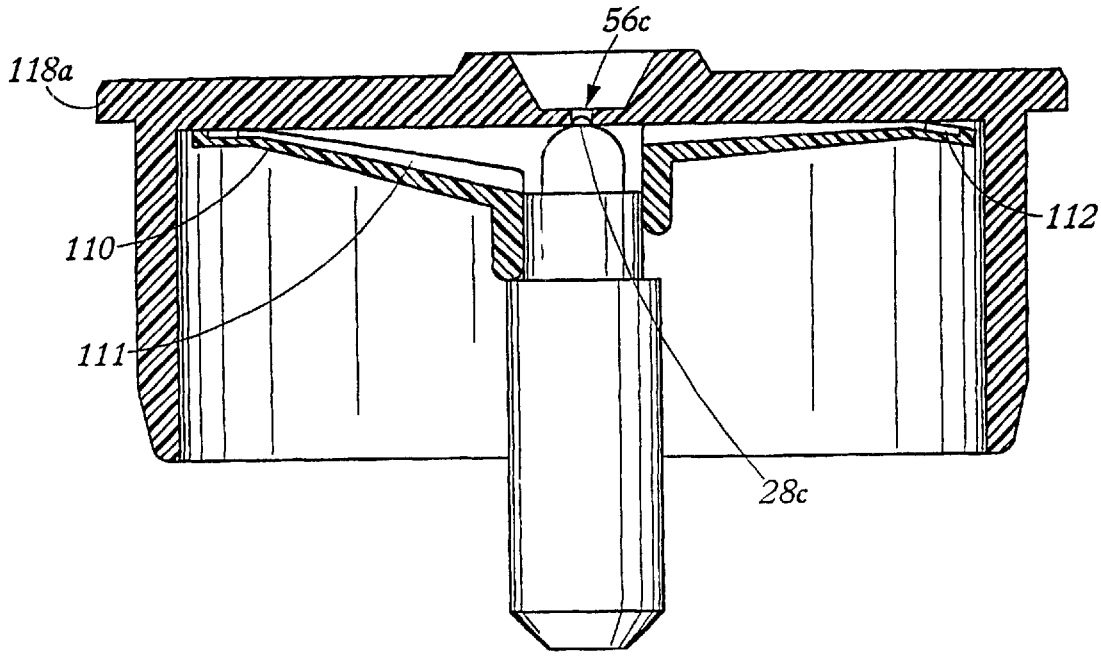
FIG. 11A is a sectional view of an alternate embodiment of the actuator assembly showing an insert with a diaphragm MBU piece.
Figure 11B:
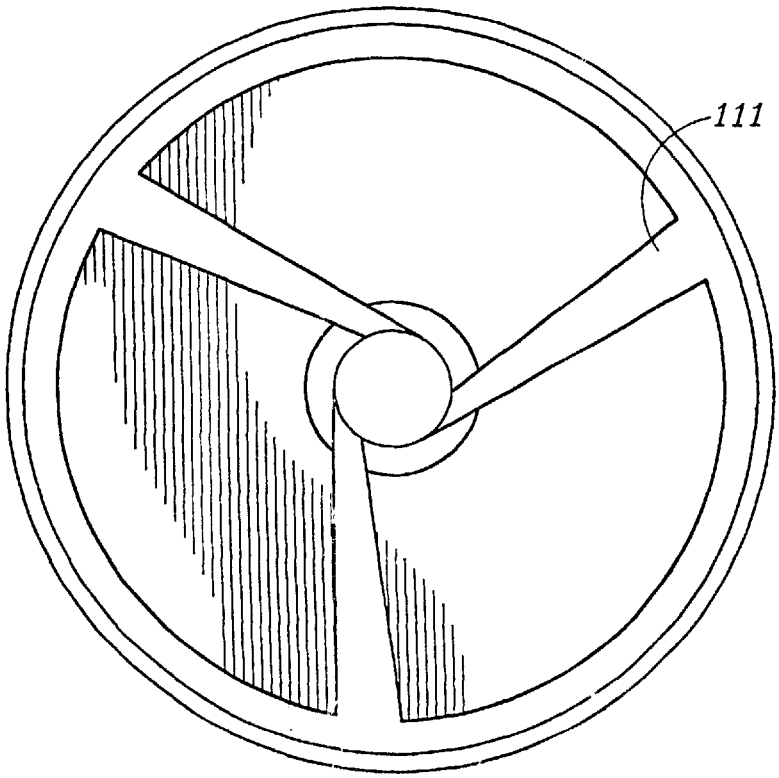
FIG. 11B is an overhead view of the diaphragm MBU piece of FIG. 11A.

With reference to FIGS. 10A, 10B, and 10C, a familiar valve post assembly 190*a*, similar to that utilized in the alternative embodiment illustrated in FIG. 9, incorporates a one-piece molded assembly housing 100 that provides for the threadable attachment of the compression fitting 118. The molded assembly housing 100 also utilizes capillary circumferential pockets 92*a*, similar to the capillary circumferential pocket 92 in FIG. 7, for the same purpose of reducing product bleeding at the completion of the dispensing cycle.

Similar to other disclosed embodiments, the compression fitting 118 restricts the flexible fitment 116 which is itself also restricted by the valve post 190*a*. As in other disclosed embodiments, the pressure of the product flow serves to lift the face of the flexible fitment 116 off of the valve post 190*a* allowing for product to be dispensed. As the compression fitting 118 lifts higher with the flexible fitment 116, the spray pattern of the product changes or varies from a wide spray to a narrower spray. As seen in FIG. 10B, the flexible fitment 116 comprises two depending walls 120 that sealably contact the valve post 190*a*. Under pressure, the two depending walls 120 and the flexible fitment lip seal 56*b* flex away from the valve post 190*a* thus creating a product flow slot up along the valve post 190*a*. In FIG. 10C, the openings 122 of the two depending walls 120 are shown to be the entrance for the product. As product flows through the openings 122 of the two depending walls 120, the geometry of the walls 120 creates a swirling action of the product which leads to atomizes the product as it swirls around the valve post 190*a* and up to the flexible fitment lip seal 56*b*.

Alternatively, flexible diaphragms and gaskets can be employed to accomplish similar valving results as those disclosed in the embodiments discussed above. In order to obtain specific spray patterns, the alternate embodiment illustrated in FIG. 10 can be customized to yield the alternative embodiments of non-clog actuator inserts illustrated in FIGS. 11A and 12A. Each incorporates a threaded stem fitment and a threaded compression fitment that are employed to create a more precise custom retrofit. The alternate embodiment illustrated in FIG. 11A discloses an actuator assembly with a flexible diaphragm 110, featuring a swirled pattern of vortex channels 111 situated 120° apart on its face (see FIG. 11B), abutting a threaded compression fitting 118*a* with smooth underside, cumulatively forming one-way valving means. In this embodiment, product under pressure pushes the diaphragm 110 from the underside upwards and flat against the smooth face of the underside of the threaded compression fitting 118, causing the peripheral edge 112 of the diaphragm 110 to dip down, thus providing a path for the product to reach the vortex channels 111 upon the face of the diaphragm 110 where the pressure forces the lip seal 56*c* off the tip 28*c*.

Figure 12A:
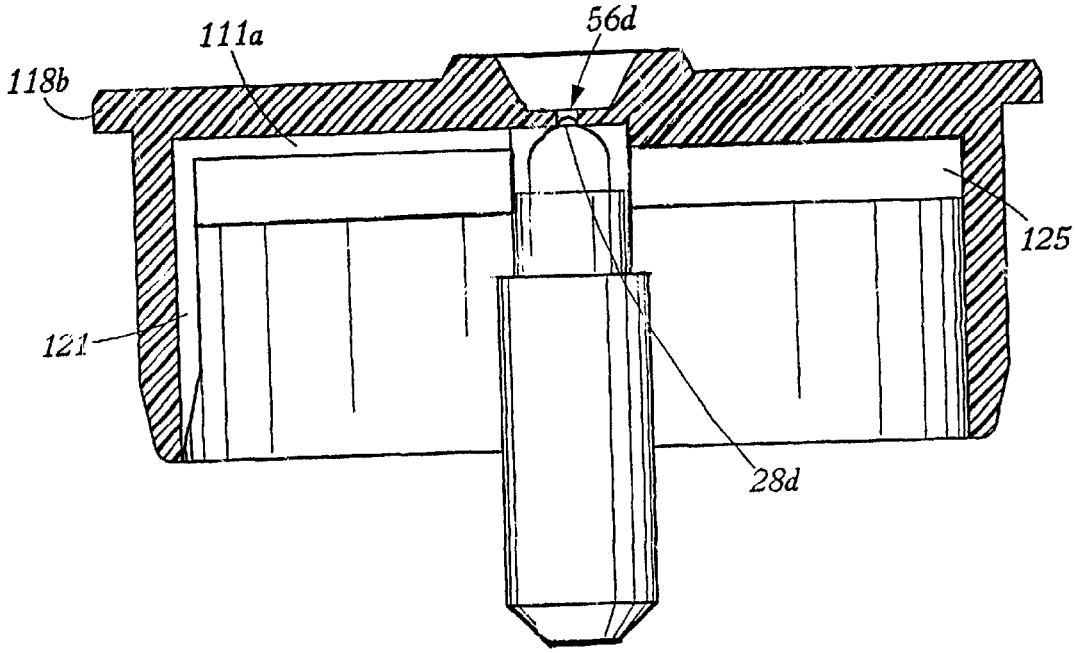
FIG. 12A is a sectional view of an alternate embodiment of the actuator assembly showing an insert with a die cut gasket and a compression fitment.
Figure 12B:
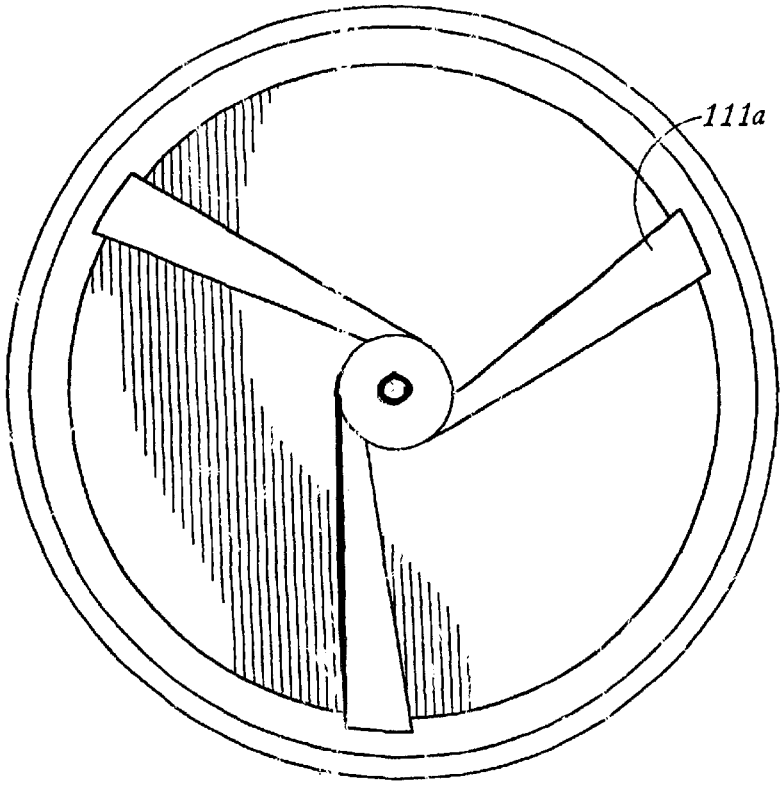
FIG. 12B is a bottom view of the compression fitment MBU of FIG. 12A.

The alternate embodiment illustrated in FIG. 12A discloses an actuator assembly with a flexible die cut gasket 125 with a smooth face abutting a threaded compression fitting 118*b* featuring a swirled pattern of vortex channels 111 a situated 120° apart on its underside (see FIG. 12B), cumulatively forming one-way valving means. In this embodiment, product under pressure pushes the die cut gasket 125 upwards against the swirled pattern of vortex channels 111*a* a on the underside of the threaded compression fitting 118*b*, causing the gasket 125 and the smooth face of compression fitting 118*b* to flex together, upwards, where the pressure forces the lip seal 56*d* off the tip 28*d*. The product path in this embodiment is through the vertical grooves 121 situated directly along the inner wall of compression fitting 118*b* and around gasket 125 which provides a path for the product to reach the vortex channels 111*a* upon the underside of the threaded compression fitting 118*b*.

In both of the above-disclosed embodiments, the compression fittings 118*a* and 118*b* can either be snapped into position or threadably attached, although the embodiments are not limited to any particular means of connection. Likewise, brass, or another metal, can be used in addition to, or instead of, plastic fitments. For instance, a threaded brass pin could be inserted in the stem area of an actuator assembly, and coupled with a brass restrictor plate that is threadably connected with a brass retainer fitment, yield additional structural durability and afford greater precision in the assembly process. The material of the fitments and fittings are not limiting factors in the disclosed invention and those materials specifically shown are presented only for purposes of illustration.

Since numerous modifications and combinations of the above method and embodiments will readily occur to those skilled in the art, it is not desired to limit the invention to the exact construction and processes shown and described above. Accordingly, resort may be made to all suitable modifications and equivalents that fall within the scope of the invention as defined by the claims which follow. The words "comprise," "comprises," "comprising," "include (s)," and "including" when used in this specification and in the following claims are intended to specify the presence of stated features or steps, but they do not preclude the presence or addition of one or more other features, steps, or groups thereof.

What is claimed is:

1. A non-clog actuator assembly, comprising:

(a) a stem carried within the actuator assembly, the stem having a stem side wall and a stem face;

(b) a flexible fitment disposed over the stem, the flexible fitment having a flexible fitment side wall and flexible fitment face, an orifice on the flexible fitment face;

(c) wherein the flexible fitment has a first position in which the flexible fitment side wall sealably contacts the stem side wall and the flexible fitment face sealably contacts at least a portion of the stem face; and (d) wherein the flexible fitment has a second position in which the flexible fitment side wall flexes away from the stem side wall, and the flexible fitment face flexes away from at least a portion of the stem face;

(e) wherein a compression fitment disposed about the flexible fitment side wall, the compression fitment having a dimension which arrests the flex of the flexible fitment side wall at a predetermined distance away from the stem side wall.

2. The assembly of claim 1 wherein the flexible fitment further comprises a mechanical breakup means having a turbulent vortices means.

3. The assembly of claim 1, further comprising a tip on the stem face disposed to penetrate the orifice of the flexible fitment face.

4. The assembly of claim 3, further comprising a reservoir holding a product under pressure in fluid communication with the stem side wall, and an openable valve releasing said product, said product under pressure urging the flexible fitment from the first position to the second position when the valve is open.

5. The assembly of claim 4, wherein the flexible fitment is urged from the second position to the first position when the valve is closed.

6. The assembly of claim 4, wherein the flexible fitment is urged from the second position to the first position when the pressure on the product is at or below a predetermined level.

7. The assembly of claim 5, further comprising turbo vortexing channels on the stem face.

8. The assembly of claim 7, further comprising flow channels on the stem side wall.

9. The assembly of claim 8, further comprising means for concentrically combining and retaining the stem, the flexible fitment and the compression fitting.

10. The assembly of claim 9, wherein said means provide for permanent alignment of the stem, the flexible fitment and the compression fitting.

11. The assembly of claim 10, wherein the means for permanent alignment is accomplished by snap-fitting the compression fitting into position over the stem and the flexible fitment.

12. The assembly of claim 10, wherein the compression fitting is threaded.

13. The assembly of claim 12, wherein the means for permanent alignment is accomplished by threadably connecting the compression fitting into position over the stem and the flexible fitment.

14. The assembly of claim 1, wherein the compression fitting is plastic.

15. The assembly of claim 1, wherein the compression fitting is metal.

16. The assembly of claim 1, wherein a non-clog actuator valve post is disposed within the stem, the valve post further comprising a valve post side and a valve post face.

17. The assembly of claim 16, wherein a gasket is disposed between the valve post face and the compression fitting.

18. The assembly of claim 17, wherein said gasket is flexible.

19. The assembly of claim 18, wherein the compression fitting includes a vortex/swirl chamber pattern within its underside.

20. The assembly of claim 19, further comprising means for concentrically combining and retaining the valve post, the gasket and the compression fitting.

21. The assembly of claim 20, wherein said means provide for permanent alignment of the valve post, the gasket and the compression fitting.

22. The assembly of claim 21, wherein the means for permanent alignment is accomplished by snap-fitting the compression fitting into position over the valve post and the gasket.

23. The assembly of claim 21, wherein the compression fitting is threaded.

24. The assembly of claim 23, wherein the means for permanent alignment is accomplished by threadably connecting the compression fitting into position over the valve post and the gasket.

25. The assembly of claim 16, wherein a diaphragm is disposed between the valve post face and the compression fitting.

26. The assembly of claim 25, wherein said diaphragm is flexible.

27. The assembly of claim 26, wherein the diaphragm includes a vortex/swirl pattern on its face.

28. The assembly of claim 27, wherein the compression fitting includes a smooth underside.

29. The assembly of claim 28, further comprising means for concentrically combining and retaining the valve post, the diaphragm and the compression fitting.

30. The assembly of claim 29, wherein said means provide for permanent alignment of the valve post, the diaphragm and the compression fitting.

31. The assembly of claim 30, wherein the means for permanent alignment is accomplished by snap-fitting the compression fitting into position over the stem and the diaphragm.

32. The assembly of claim 30, wherein the compression fitting is threaded.

33. The assembly of claim 32, wherein the means for permanent alignment is accomplished by threadably connecting the compression fitting into position over the valve post and the diaphragm.

34. A non-clog actuator assembly, comprising:

(a) a rigid stem fitment carried within the actuator assembly, the rigid stem having a stem face and a stem side wall, such that an interior annular space is defined by the stem side wall;

(b) a flexible fitment disposed over the rigid stem fitment, the flexible fitment having a flexible fitment side wall and a flexible fitment face, an orifice on the flexible fitment face, and a seal bead ring surrounding an outer surface of the flexible fitment side wall;

(c) an actuator fitment, the actuator fitment having a first protrusion disposed beneath and within the interior annular space of the rigid stem fitment, and a second protrusion forming an outer wall surrounding the rigid stem fitment;

(d) wherein the flexible fitment has a first position in which at least a portion of the flexible fitment side wall sealably contacts at least a portion of the outer wall of the actuator fitment and the flexible fitment face sealably contacts at least a portion of the stem face of the rigid stem fitment; and (e) wherein the flexible fitment has a second position in which the flexible fitment side wall with the seal bead ring flexes away from the wall of a compression fitting and the flexible fitment face flexes away from at least a portion of the stem face of the rigid stem fitment.

35. The assembly of claim 34, further comprising a compression fitting disposed about the flexible fitment side wall, the compression fitting having a dimension which arrests the flex of the flexible fitment side wall with the seal bead ring at a predetermined distance away from the rigid stem side wall.

36. The assembly of claim 35, further comprising a reservoir holding a product under pressure in fluid communication with the seal bead ring, and an openable valve releasing said product, said product under pressure urging the flexible fitment from the first position to the second position when the valve is open.

37. The assembly of claim 36, wherein the flexible fitment is urged from the second position to the first position when the valve is closed.

38. The assembly of claim 37, wherein the flexible fitment is urged form the second position to the first position when the pressure on the product is at or below a predetermined level.

39. The assembly of claim 38, further comprising an area defined between the rigid stem fitment and the flexible fitment, said area decreasing in capacity when the flexible fitment is urged from the first position to the second position, and said area increasing in capacity when the flexible fitment is urged from the second position to the first position.

40. The assembly of claim 39, further comprising turbo vortexing channels on the face of the rigid stem fitment.

41. The assembly of claim 40, further comprising turbo vortexing channels on an underside of the face of the flexible fitment.

42. The assembly of claim 41, further comprising flow channels on the side wall of the rigid tem fitment.

43. The assembly of claim 42, further comprising means for concentrically combining and retaining the rigid stem fitment, the flexible fitment and the compression fitting.

44. The assembly of claim 43, wherein said means provide for permanent alignment of the rigid stem fitment, the flexible face fitment and the compression fitting.

45. The assembly of claim 44, wherein the means for permanent alignment is accomplished by barb-fitting the compression fitting into position over the rigid stem fitment and the flexible fitment.

46. The assembly of claim 44, wherein the compression fitting is threaded.

47. The assembly of claim 46, wherein the means for permanent alignment is accomplished by threadably connecting the compression fitting into position over the rigid stem fitment and the flexible fitment.

48. The assembly of claim 35, wherein the compression fitting is plastic.

49. The assembly of claim 35, wherein the compression fitting is metal.

* * * * *